US010639911B2

(12) United States Patent
Kajiya

(10) Patent No.: US 10,639,911 B2
(45) Date of Patent: May 5, 2020

(54) PRINTING APPARATUS AND PRINTING METHOD

(71) Applicant: SCREEN HOLDINGS CO., LTD., Kyoto (JP)

(72) Inventor: Hiroyuki Kajiya, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 16/129,391

(22) Filed: Sep. 12, 2018

(65) Prior Publication Data

US 2019/0092046 A1 Mar. 28, 2019

(30) Foreign Application Priority Data

Sep. 22, 2017 (JP) ..... 2017-182623

(51) Int. Cl.

| | |
|---|---|
| ***B41J 11/00*** | (2006.01) |
| ***B41J 15/16*** | (2006.01) |
| ***B41J 2/185*** | (2006.01) |
| ***B41J 29/393*** | (2006.01) |
| ***B65H 27/00*** | (2006.01) |

(52) U.S. Cl.

CPC ..... *B41J 11/0005* (2013.01); *B41J 2/185* (2013.01); *B41J 11/005* (2013.01); *B41J 15/165* (2013.01); *B41J 29/393* (2013.01); *B65H 27/00* (2013.01); *B65H 2404/1313* (2013.01)

(58) Field of Classification Search

CPC .... B41J 11/0005; B41J 29/393; B41J 11/005; B41J 15/165; B41J 2/185; B65H 27/00; B65H 2404/1313

USPC ..... 347/104

See application file for complete search history.

(56) References Cited

U.S. PATENT DOCUMENTS

| | | | | |
|---|---|---|---|---|
| 9,108,817 | B1 | 8/2015 | Muir et al. | |
| 2006/0214984 | A1 | 9/2006 | Hirakawa | |
| 2007/0132824 | A1* | 6/2007 | Iida | B41J 11/0065 347/101 |
| 2012/0218336 | A1* | 8/2012 | Okada | B41J 2/2142 347/14 |
| 2012/0224009 | A1 | 9/2012 | Kasiske, Jr. et al. | |

(Continued)

FOREIGN PATENT DOCUMENTS

JP 2009-227446 A 10/2009

OTHER PUBLICATIONS

Extended European Search Report issued in corresponding European Patent Application No. 18191366.6-1019, dated Feb. 1, 2019.

*Primary Examiner* — Huan H Tran
*Assistant Examiner* — Alexander D Shenderov
(74) *Attorney, Agent, or Firm* — McDermott Will & Emery LLP

(57) ABSTRACT

The ink is discharged to the printing medium F located in the first range R1 from the upstream end Wuu of the upstream winding part Wu where the support roller 26*a* and the printing medium F are in contact to the downstream end Wdd of the downstream winding part Wd where the support roller 26*e* and the printing medium F are in contact. The support rollers 26*a*, 26*e* located on both ends of the first range R1 are in contact with the printing medium F on the peripheral surfaces 261 having such a concave shape to increase the diameter from the center toward the ends in the width direction Y (axial direction). This causes these support rollers 26*a*, 26*e* to suppress the formation of wrinkles in the first range R1 where the ink is discharged.

8 Claims, 5 Drawing Sheets

(56) References Cited

U.S. PATENT DOCUMENTS

| | | | | |
|---|---|---|---|---|
| 2015/0166290 | A1* | 6/2015 | Piatt | B65H 23/26<br>242/615.12 |
| 2015/0239690 | A1 | 8/2015 | Muir et al. | |
| 2016/0167406 | A1 | 6/2016 | Piatt et al. | |
| 2017/0021643 | A1* | 1/2017 | Sasaki | B41J 11/0085 |
| 2019/0135007 | A1* | 5/2019 | Shields | B41M 5/0047 |

* cited by examiner

PRINTING APPARATUS AND PRINTING METHOD

CROSS REFERENCE TO RELATED APPLICATION

The disclosure of Japanese Patent Application No. 2017-182623 filed on Sep. 22, 2017 including specification, drawings and claims is incorporated herein by reference in its entirety.

BACKGROUND OF THE INVENTION

1. Field of the Invention

This invention relates to a printing technique for performing printing by discharging ink to a printing medium being conveyed in a conveying direction.

2. Description of the Related Art

In a conveying technique for conveying a web by a roll-to-roll method or the like, wrinkles (so-called troughs and folding wrinkles) formed according to conveyance have become problematic in some cases. Accordingly, in patent literature 1, the formation of wrinkles is suppressed by conveying a web using a guide roller having a peripheral surface shaped to increase a diameter from a center toward ends in an axial direction (so-called concave roller).

SUMMARY OF THE INVENTION

A printing apparatus is known which prints an image by discharging ink to a printing medium while conveying the printing medium in a conveying direction. Also in conveying a printing medium in such a printing apparatus, it is expected to suppress the formation of wrinkles by using the above roller. In this case, what is important in the printing apparatus is to suppress the formation of wrinkles in a range to which the ink is discharged. However, a technique sufficiently taking into account this point has not be found in prior art including patent literature 1.

This invention was developed in view of the above problem and aims to enable the formation of wrinkles in the range to which the ink is discharged to be suppressed in printing an image on a printing medium by discharging ink while conveying the printing medium in a conveying direction.

One aspect of this invention is directed to a printing apparatus, comprising: a conveying unit including an upstream roller and a downstream roller located downstream of the upstream roller in a conveying direction and configured to convey a printing medium in contact with the upstream roller and the downstream roller in the conveying direction by rotating the upstream roller and the downstream roller; and an ink discharging unit configured to discharge ink to the printing medium being conveyed by the conveying unit; wherein: each of the upstream roller and the downstream roller is in contact with the printing medium on a peripheral surface shaped to increase a diameter from a center toward ends in an axial direction; and the ink discharging unit discharges the ink to the printing medium located in a first range from an upstream end of an upstream contact part, where the upstream roller and the printing medium are in contact, to a downstream end of a downstream contact part, where the downstream roller and the printing medium are in contact, in the conveying direction.

Another aspect of this invention is directed to a printing method, comprising: rotating an upstream roller and a downstream roller located downstream of the upstream roller in a conveying direction to convey a printing medium in contact with the upstream roller and the downstream roller in the conveying direction; and discharging ink to the printing medium located in a first range from an upstream end of an upstream contact part, where the upstream roller and the printing medium are in contact, to a downstream end of a downstream contact part, where the downstream roller and the printing medium are in contact, in the conveying direction, wherein each of the upstream roller and the downstream roller is in contact with the printing medium on a peripheral surface shaped to increase a diameter from a center toward ends in an axial direction.

In the invention (printing apparatus, printing method) thus configured, the upstream roller and the downstream roller rotate to convey the printing medium in contact with these rollers. Then, the ink is discharged to the printing medium located in the first range from the upstream end of the upstream contact part, where the upstream roller and the printing medium are in contact, to the downstream end of the downstream contact part, where the downstream roller and the printing medium are in contact. In this case, the upstream roller and the downstream roller located on both ends in the first range are in contact with the printing medium on the peripheral surfaces shaped to increase the diameter from the center toward the ends in the axial direction. This causes the formation of wrinkles in the first range where the ink is discharged to be suppressed by these upstream and downstream rollers. In this way, the formation of wrinkles in a range to which the ink is discharged can be suppressed in printing an image by discharging the ink to the printing medium while conveying the printing medium in the conveying direction.

As described above, according to the invention, the formation of wrinkles in an ink discharge range can be suppressed in printing an image by discharging ink to a printing medium while conveying the printing medium in a conveying direction.

DETAILED DESCRIPTION OF THE PREFERRED EMBODIMENTS

Figure 1:
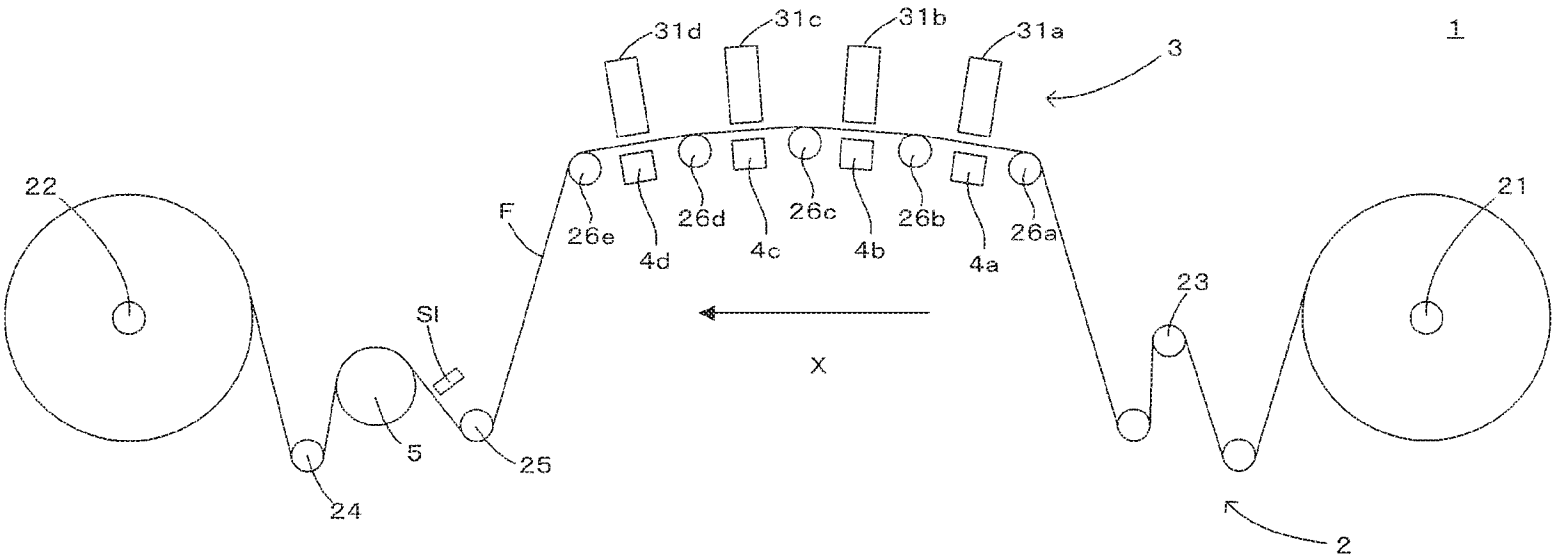
FIG. 1 is a diagram schematically showing an example of a printing apparatus according to the invention.

FIG. 1 is a diagram schematically showing an example of a printing apparatus according to the invention. This printing apparatus 1 includes a conveying unit 2 configured to convey a printing medium F, which is a film made of PET (polyethylene terephthalate), nylon, OPP (biaxially oriented polypropylene) or CPP (cast polypropylene), a laminate of those films, a soft packaging material such as cellophane or the like, in a conveying direction X, and an ink discharging unit 3 configured to discharge ink (water-based ink) to the printing medium F. The ink discharging unit 3 discharges the ink to the printing medium F being conveyed in the conveying direction X by the conveying unit 2, whereby an image is printed on the printing medium F. Note that, out of both surfaces of the printing medium F, the surface on which an image is to be printed is appropriately referred to as a front surface and a surface opposite to the front surface is referred to as a back surface.

The conveying unit 2 includes an unwinding roller 21 for feeding the printing medium F and a winding roller 22 for winding the printing medium F fed from the unwinding roller 21, and conveys the printing medium F from the unwinding roller 21 to the winding roller 22 in the conveying direction X by a roll-to-roll method. The conveying unit 2 includes two drive rollers 23, 24, on which the printing medium F is wound, between the unwinding roller 21 and the winding roller 22, and these drive rollers 23, 24 drive the printing medium F in the conveying direction X at a predetermined conveying speed. Further, the conveying unit 2 includes a sensor roller 25, on which the printing medium F is wound, between the drive rollers 23 and 24. A tension sensor S25 (FIG. 4) for measuring a tension of the printing medium F is attached to the sensor roller 25, and the drive rollers 23, 24 adjust a tension applied to the printing medium F based on a measurement value of the tension sensor S25. Further, the conveying unit 2 includes five support rollers 26*a*, 26*b*, 26*c*, 26*d* and 26*e* disposed side by side in this order in the conveying direction X between the drive roller 23 and the sensor roller 25 and arranged in parallel to each other. The printing medium F is wound by each of these support rollers 26*a* to 26*e* from its back surface side, each of these support rollers 26*a* to 26*e* rotates, following a movement of the printing medium F driven by the drive rollers 23, 24.

Figure 2:
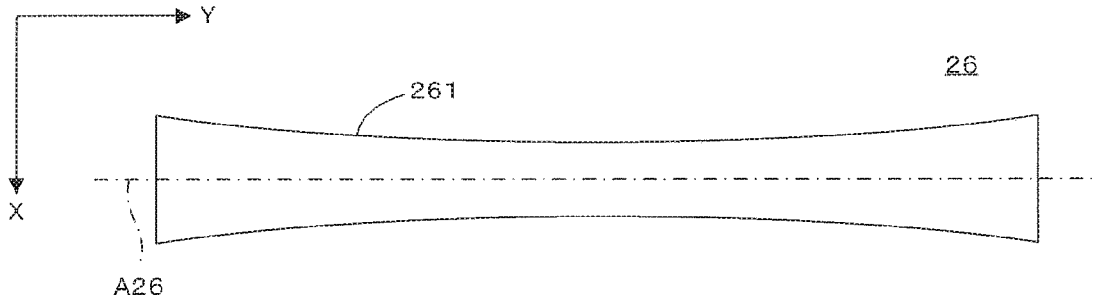
FIG. 2 is a diagram schematically showing the configuration of the support roller.

FIG. 2 is a diagram schematically showing the configuration of the support roller with the shape of the support roller emphasized. Since four support rollers 26*a* to 26*d* have the same configuration, the support rollers 26*a* to 26*d* are indicated as support rollers 26 without being distinguished here. The support roller 26 extends in a width direction Y perpendicular to the conveying direction X and a peripheral surface 261 of the support roller 26 is rotatable about a rotation axis A26 parallel to the width direction Y. Fine grooves (not shown) are formed in the peripheral surface 261 of the support roller 26 to suppress the entrance of air between the peripheral surface 261 and the printing medium F. Further, the peripheral surface 261 of the support roller 26 has a shape (concave shape) which continuously increase a diameter from a center toward both ends along the width direction Y (axial direction) and, hence, the support roller 26 is a so-called concave roller. Such a support roller 26 exhibits a function of suppressing the formation of wrinkles (wrinkles called troughs caused by buckling deformation not associated with permanent deformation) of the printing medium F wound on the peripheral surface 261.

As shown in FIG. 1, the ink discharging unit 3 includes four discharge heads 31*a* to 31*d* arranged at intervals in the conveying direction X while facing the printing medium F supported by the support rollers 26*a* to 26*e*. That is, the discharge head 31*a* faces the front surface of a part of the printing medium F supported between the support rollers 26*a* and 26*b*, the discharge head 31*b* faces the front surface of a part of the printing medium F supported between the support rollers 26*b* and 26*c*, the discharge head 31*c* faces the front surface of a part of the printing medium F supported between the support rollers 26*c* and 26*d* and the discharge head 31*d* faces the front surface of a part of the printing medium F supported between the support rollers 26*d* and 26*e*. These discharge heads 31*a* to 31*d* discharge mutually different colors (e.g. black, cyan, magenta and yellow) of ink from nozzles by an inkjet method, whereby the ink is landed on the front surface of the printing medium F. In this way, a color image is printed on the front surface of the printing medium F.

Each of these discharge heads 31*a* to 31*d* appropriately performs flushing of discharging the ink from the nozzles to suppress the clogging of the nozzle by the ink having an increased viscosity. The ink discharged from the discharge heads 31*a* to 31*d* by this flushing is basically landed on the printing medium F. However, if the printing medium F has a short length in the width direction Y, part of the ink discharged by flushing passes beside the printing medium F without being landed on the printing medium F. Accordingly, the printing apparatus 1 includes four ink receivers 4*a* to 4*d* in correspondence with the four discharge heads 31*a* to 31*d*. That is, the ink receiver 4*a* faces the discharge head 31*a* across the printing medium F, the ink receiver 4*b* faces the discharge head 31*b* across the printing medium F, the ink receiver 4*c* faces the discharge head 31*c* across the printing medium F and the ink receiver 4*d* faces the discharge head 31*d* across the printing medium F.

Figure 3:
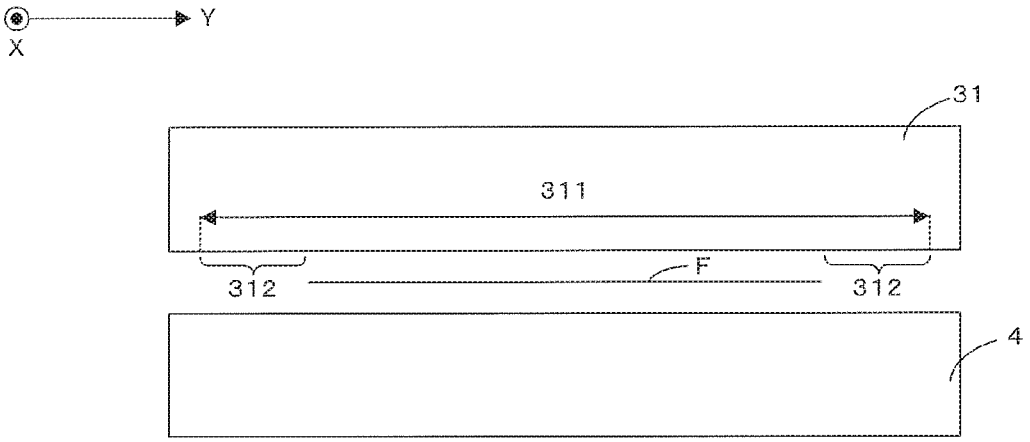
FIG. 3 is a diagram showing an exemplary positional relationship between the discharge head and the ink receiver.

FIG. 3 is a diagram showing an exemplary positional relationship between the discharge head and the ink receiver. Since the four ink receivers 4*a* to 4*d* have the same configuration, the ink receivers 4*a* to 4*d* are indicated as ink receivers 4 without being distinguished. Further, the discharge heads 31*a* to 31*d* are also similarly indicated as discharge heads 31. As shown in FIG. 3, the discharge head 31 is formed such that a plurality of nozzles are arranged in a row over an ink discharge range 311 having a predetermined width in the width direction Y and the ink is discharged from each nozzle. Since the printing medium F is conveyed in the conveying direction X between the discharge head 31 and the ink receiver 4, the ink discharged from the nozzle in a central part of the ink discharge range 311 is landed on the printing medium F. However, printing mediums F used in the printing apparatus 1 come in various widths and a printing medium F narrower than the ink discharge range 311 as shown in FIG. 3 is also used. In this case, the ink discharged from both end parts 312 of the ink discharge range 311 passes beside the printing medium F in the width direction Y without being landed on the printing medium F. Accordingly, the ink receiver 4 is provided to face the entire ink discharge range 311 and the ink passing beside the printing medium F is received by the ink receiver 4.

As shown in FIG. 1, the printing apparatus 1 includes a drying unit 5 arranged downstream of the support roller 26*e* in the conveying direction X. The drying unit 5 dries the ink discharged to the printing medium F from the discharge heads 31*a* to 31*d* by heating the printing medium F by a heater. Note that such a drying unit 5 is not limited to this and the discharged ink may be dried by blowing hot air to the printing medium F.

Further, the printing apparatus 1 includes a line sensor S1 arranged downstream of the support roller 26*e* in the conveying direction X, specifically between the support roller 26*e* and the drying unit 5. The line sensor S1 faces the front surface of the printing medium F and can image an image printed on the front surface of the printing medium F.

Figure 4:
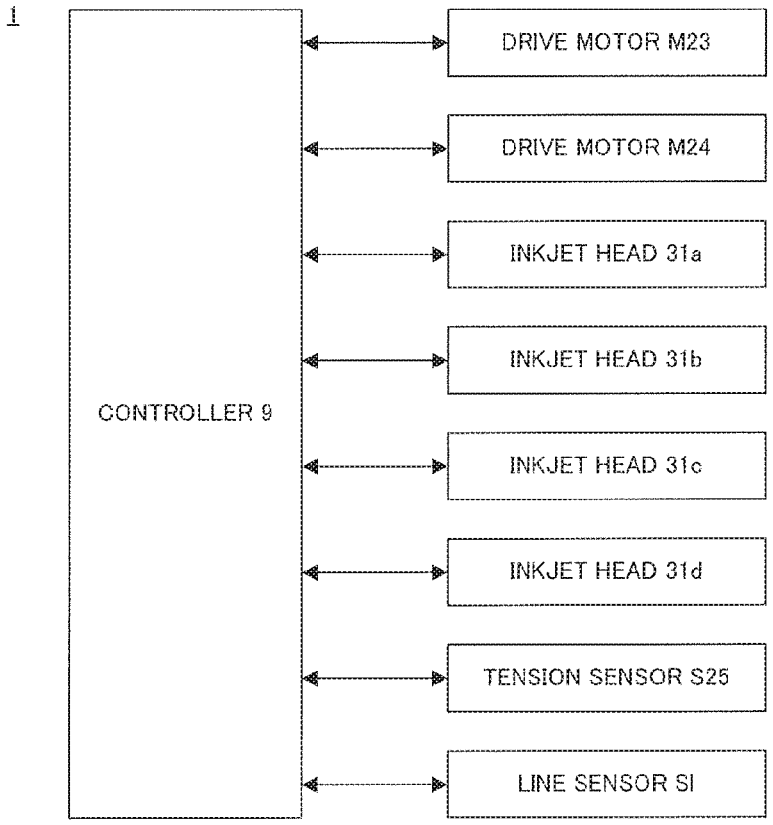
FIG. 4 is a block diagram showing an electrical configuration of the printing apparatus of FIG. 1.

FIG. 4 is a block diagram showing an electrical configuration of the printing apparatus of FIG. 1. As shown in FIG. 4, the printing apparatus 1 includes a controller 9, which is a processor constituted by a CPU (Central Processing Unit) and a RAM (Random Access Memory). Further, the printing apparatus 1 includes a drive motor M23 for driving the drive roller 23 and a drive motor M24 for driving the drive roller 24. These drive motors M23, M24 are servo motors, and the controller 9 conveys the printing medium F at a certain speed in the conveying direction X by controlling a rotational speed of one of the drive motors M23, M24 based on an encoder output thereof. Further, the controller 9 applies a certain tension to the printing medium F by controlling a torque of another of the drive motors M23, M24 based on a detection value of the tension sensor S25. Furthermore, the controller 9 causes the ink to land at predetermined positions of the front surface of the printing medium F by controlling ink discharge timings of the discharge heads 31*a* to 31*d* according to the speed of the printing medium F conveyed by the drive motors M23, M24. Further, as described later, the controller 9 also functions to correct the ink discharge timings of the discharge heads 31*a* to 31*d* based on a result of imaging an image by the line sensor S1.

Figure 5:
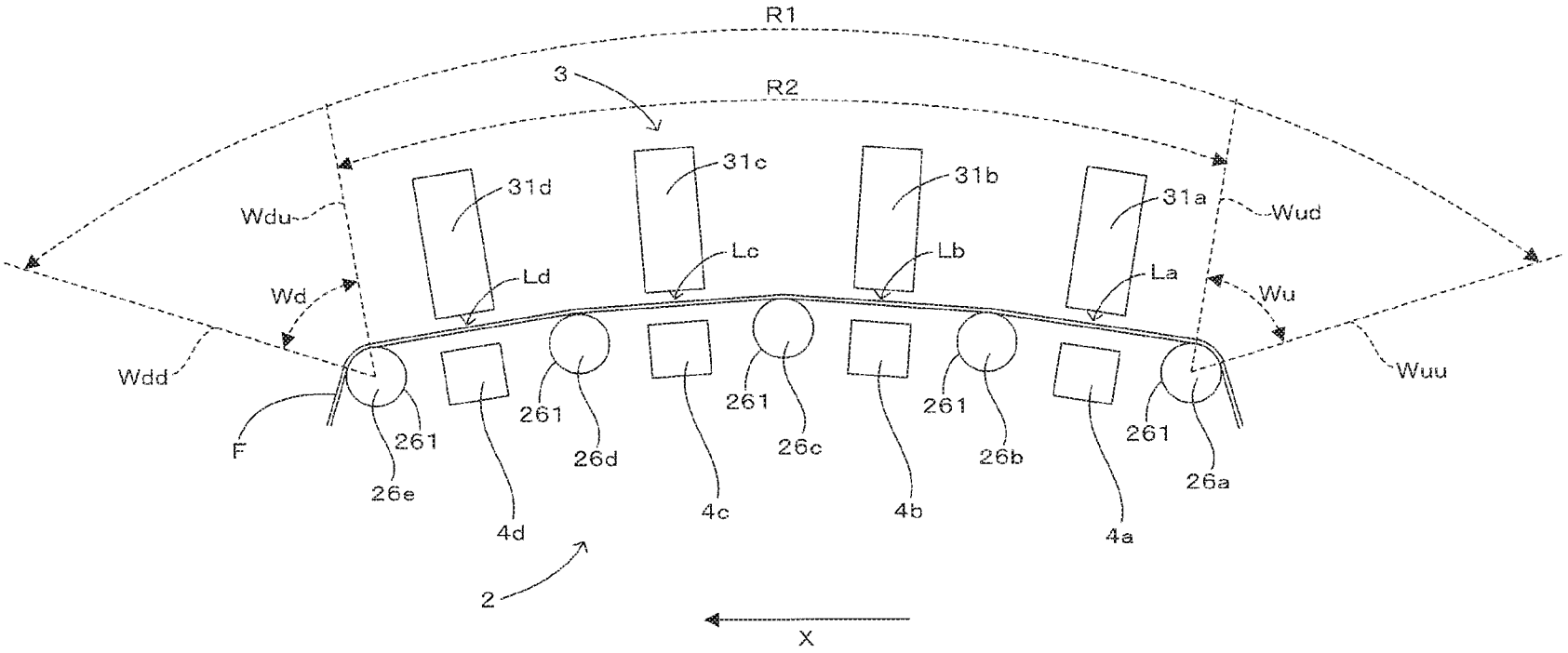
FIG. 5 is a diagram schematically showing an exemplary positional relationship between the support rollers and the discharge heads.

FIG. 5 is a diagram schematically showing an exemplary positional relationship between the support rollers and the discharge heads. As shown in FIG. 5, the printing medium F is wound with the peripheral surface 261 of each of the five support rollers 26*a* to 26*e* held in contact with the back surface of the printing medium F. Out of the five support rollers 26*a* to 26*e*, the support roller 26*a* most upstream in the conveying direction X has the printing medium F wound thereon to form an upstream winding part Wu and the support roller 26*e* most downstream in the conveying direction X has the printing medium F wound thereon to form a downstream winding part Wd. In other words, the support roller 26*a* has the printing medium F wound thereon at the upstream winding part Wu and the support roller 26*e* has the printing medium F wound thereon at the downstream winding part Wd. Further, a winding angle of each of the upstream winding part Wu and the downstream winding part Wd of the support rollers 26*a*, 26*e* is larger than a winding angle of the printing medium F on each of the support rollers 26*b* to 26*d* between the support rollers 26*a* and 26*e*.

The four discharge heads 31*a* to 31*d* face the front surface of the printing medium F within a first range R1 from an upstream end Wuu of the upstream winding part Wu to a downstream end Wdd of the downstream winding part Wd in the conveying direction X. Thus, landing positions La to Ld where the ink discharged by the discharge heads 31*a* to 31*d* is landed on the front surface of the printing medium F are arranged at intervals in the conveying direction X within the first range R1. Particularly in an example of FIG. 5, the four discharge heads 31*a* to 31*d* face the front surface of the printing medium F within a second range R2 from a downstream end Wud of the upstream winding part Wu to an upstream end Wdu of the downstream winding part Wd in the conveying direction X and the landing positions La to Ld are arranged at intervals in the conveying direction X within the second range R2.

Further, the support roller 26*b* is in contact with the back surface of the printing medium F between two landing positions La and Lb adjacent in the conveying direction X, the support roller 26*c* is in contact with the back surface of the printing medium F between two landing positions Lb and Lc adjacent in the conveying direction X and the support roller 26*d* is in contact with the back surface of the printing medium F between two landing positions Lc and Ld adjacent in the conveying direction X. That is, the landing position La is located between the support rollers 26*a* and 26*b*, the landing position Lb is located between the support rollers 26*b* and 26*c*, the landing position Lc is located between the support rollers 26*c* and 26*d* and the landing position Ld is located between the support rollers 26*d* and 26*e*.

In such a configuration, the formation of wrinkles of the printing medium F in the first range R1 is suppressed by the support rollers 26*a* to 26*e*. However, a surface shape of the printing medium F is deformed according to the concave shape of the support rollers 26*a* to 26*e*. Thus, a distance from the discharge head 31*a* to 31*d* to the front surface of the printing medium F becomes shorter from the center toward both ends of the printing medium F along the width direction Y. Therefore, the ink is landed earlier in the both ends than in the center of the printing medium F, whereby a printed image is distorted. Accordingly, the controller 9 suppresses a distortion of the image by correcting the ink discharge timings of the discharge heads 31*a* to 31*d*.

Figure 6:
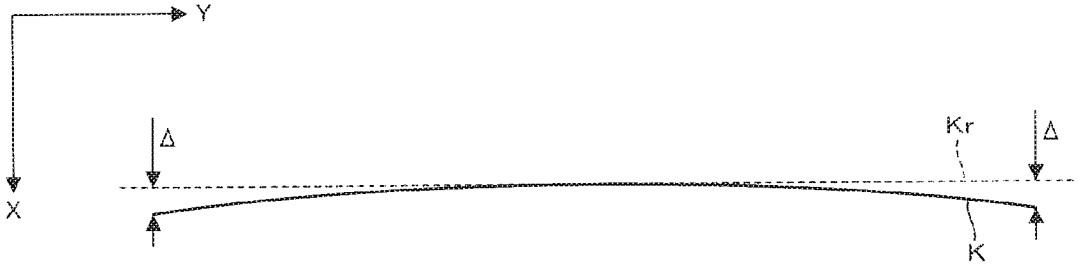
FIG. 6 is a diagram schematically showing an example of a distortion suppressing control for suppressing a distortion of an image due to the concave shape of the support roller.

FIG. 6 is a diagram schematically showing an example of a distortion suppressing control for suppressing a distortion of an image due to the concave shape of the support roller. Since this distortion suppressing control is similarly executed for each of the discharge heads 31*a* to 31*d*, the discharge heads 31*a* to 31*d* are appropriately referred to as the discharge heads 31 without being distinguished. In the distortion suppressing control, the controller 9 causes each nozzle of the discharge head 31 to simultaneously discharge the ink while conveying the printing medium F in the conveying direction X by the conveying unit 2, thereby printing a test mark K on the front surface of the printing medium F. As shown in FIG. 6, the test mark K has a distortion due to the concave shape of the support roller 26*a* to 26*e* and a positional deviation Δ which bend toward the downstream side in conveying direction X as going from the center toward both ends of the printing medium along width direction Y occurs in the test mark K.

Accordingly, the controller 9 images the test mark K by the line sensor S1, when the test mark K passes through a visual field of the line sensor S1, and calculates the positional deviation Δ from an imaged image of the test mark K. Then, the controller 9 corrects the positional deviation Δ by adjusting the timing at which the discharge head 31 discharges ink based on a calculation result of the positional deviation Δ. Specifically, the positional deviation Δ is corrected by delaying the ink discharge timing from the nozzles as going from the center toward the both ends along the width direction Y. Note that such a distortion suppressing control is executed for each of the discharge heads 31*a* to 31*d* before image printing is started.

As described above, in this embodiment, the support rollers 26*a*, 26*e* rotate to convey the printing medium F in contact with these rollers. Then, the ink is discharged to the printing medium F located in the first range R1 from the upstream end Wuu of the upstream winding part Wu where the support roller 26*a* and the printing medium F are in contact to the downstream end Wdd of the downstream winding part Wd where the support roller 26*e* and the printing medium F are in contact. In this case, the support rollers 26*a*, 26*e* located on both ends of the first range R1 are in contact with the printing medium F on the peripheral surfaces 261 having such a concave shape to increase the diameter from the center toward the ends in the width direction Y (axial direction). This causes these support rollers 26*a*, 26*e* to suppress the formation of wrinkles in the first range R1 where the ink is discharged. In this way, the formation of wrinkles in the range to which the ink is discharged can be suppressed in printing an image by discharging the ink to the printing medium F while conveying the printing medium F in the conveying direction X.

Further, the ink discharging unit 3 discharges the ink to the printing medium F located in the second range R2 from the downstream end Wud of the upstream winding part Wu to the upstream end Wdu of the downstream winding part Wd in the conveying direction X, out of the first range R1. In such a configuration, the ink is discharged in the second range R2 between the support rollers 26*a* and 26*e* where the formation of wrinkles is suppressed by these rollers. In this way, the formation of wrinkles in the range to which the ink is discharged can be suppressed.

Further, the ink discharging unit 3 includes the plurality of discharge heads 31*a* to 31*d* arranged in the conveying direction X and makes the plurality of discharge heads 31*a* to 31*d* discharge the ink to the landing positions La to Ld respectively corresponding to the plurality of discharge heads 31*a* to 31*d*. This causes the ink to be landed at the plurality of landing positions La to Ld arranged at intervals in the conveying direction X within the second range R2. Further, the conveying unit 2 includes the support rollers 26*b* to 26*d* located between the support rollers 26*a* and 26*e* in the conveying direction X, and the support rollers 26*b* to 26*d* are in contact with the printing medium F between adjacent ones of the landing positions La to Ld in the conveying direction X. These support rollers 26*b* to 26*d* have the concave shape. In such a configuration, the formation of wrinkles at each landing position La to Ld of the ink can be suppressed by the support rollers 26*a* to 26*e*.

Further, the ink receiver 4*a* to 4*d* arranged to face the discharge head 31*a* to 31*d* is provided for each discharge head 31*a* to 31*d*, and the conveying unit 2 causes the printing medium F to pass between the discharge heads 31*a* to 31*d* and the ink receivers 4*a* to 4*d* facing each other. The ink receivers 4*a* to 4*d* receive the ink discharged from the corresponding discharge heads 31*a* to 31*d* and passing beside the printing medium F without being landed on the printing medium F. In such a configuration, out of the ink discharged from the discharge heads 31*a* to 31*d* for the maintenance of the discharge heads 31*a* to 31*d*, the ink not landed on the printing medium F can be received by the ink receivers 4*a* to 4*d*. In addition, since each landing position La to Ld is provided between adjacent ones of the respective support rollers 26*a* to 26*e*, the ink receivers 4*a* to 4*d* can be arranged between adjacent ones of these support rollers 26*a* to 26*e*. In this way, an efficient layout is realized by preventing interference between the support rollers 26*a* to 26*e* and the ink receivers 4*a* to 4*d*.

Further, the line sensor S1 is provided which detects the position of the ink discharged from the ink discharging unit 3 to the printing medium F, and the controller 9 controls the timing at which ink discharging unit 3 discharges the ink based on the position of the ink detected by the line sensor S1. This causes the controller 9 to correct a positional deviation of the ink due to the concave shape of the peripheral surface 261 of each support roller 26*a* to 26*e*. In such a configuration, a good image can be printed by suppressing the positional deviation of the ink due to the concave shape of the peripheral surface 261 of each support roller 26*a* to 26*e*.

Further, the printing medium F is a soft packaging material and the ink discharging unit 3 discharges the water-based ink. That is, even in the case of using a soft packaging material as the printing medium F, a good image can be printed with the water-based ink by suppressing the formation of wrinkles in the range to which the ink is discharged according to the above configuration. Note that water-based pigment ink is preferable as such water-based ink.

As described above, in the above embodiment, the printing apparatus 1 corresponds to an example of a "printing apparatus" of the invention, the conveying unit 2 corresponds to an example of a "conveying unit" of the invention, the support roller 26*a* corresponds to an example of an "upstream roller" of the invention, the support roller 26*e* corresponds to an example of a "downstream roller" of the invention, each of the support rollers 26*b* to 26*d* corresponds to an example of an "intermediate roller" of the invention, the ink discharging unit 3 corresponds to an example of an "ink discharging unit" of the invention, each of the discharge heads 31*a* to 31*d* corresponds to an example of a "discharge head" of the invention, the ink receivers 4*a* to 4*d* correspond to an example of "ink receivers" of the invention, the line sensor S1 corresponds to an example of a "detecting unit" of the invention, and the controller 9 corresponds to an example of a "control unit" of the invention.

Further, the conveying direction X corresponds to an example of a "conveying direction" of the invention, the width direction Y corresponds to an example of an "axial direction" of the invention, the printing medium F corresponds to an example of a "printing medium" of the invention, the upstream winding part Wu corresponds to an example of an "upstream contact part" of the invention, the upstream end Wuu corresponds to an example of an "upstream end of the upstream contact part" of the invention, the downstream end Wud corresponds to an example of a "downstream end of the upstream contact part" of the invention, the downstream winding part Wd corresponds to an example of a "downstream contact part" of the invention, the downstream end Wdd corresponds to an example of a "downstream end of the downstream contact part" of the invention, the upstream end Wdu corresponds to an example of an "upstream end of the downstream contact part" of the invention, the first range R1 corresponds to an example of a "first range" of the invention, and the second range R2 corresponds to an example of a "second range" of the invention.

Note that the invention is not limited to the above embodiment and various changes other than those described above can be made without departing from the gist of the invention. For example, the arrangement of the discharge heads 31*a* to 31*d* may be changed. Specifically the discharge head 31*a* may be opposed to the support roller 26*a*, the discharge head 31*b* may be opposed to the support roller 26*b*, the discharge head 31*c* may be disposed to the support roller 26*d* and the discharge head 31*d* may be opposed to the support roller 26*e*.

Further, the number of the discharge heads 31 can be appropriately changed. Six or eight discharge heads 31 may be, for example, provided according to the number of types of ink used or one discharge head 31 may be provided. Further, the specific configuration (alignment of the nozzles and the like) of the discharge heads 31 can also be appropriately changed.

Further, the first and second ranges R1, R2 may be supported only by two support rollers 26*a*, 26*e* without providing the support rollers 26*b* to 26*d*.

Further, the arrangement of the line sensor S1 may be changed. Furthermore, the specific configuration for detecting the test mark K is not limited to the line sensor S1 and may be an area sensor.

Further, the shape, number and the like of the test marks K may be appropriately changed. For example, a plurality of test marks K may be formed by each of the discharge heads 31*a* to 31*d*, and the timing at which the ink is discharged from each discharge head 31*a* to 31*d* may be controlled based on an average value of positional deviations Δ obtained from the respective test marks K.

Further, the printing medium F is not limited to the soft packaging material and the ink used is also not limited to the water-based ink.

As the specific embodiment has been illustrated and described above, according to this invention, the printing apparatus may be configured so that the ink discharging unit discharges the ink to the printing medium located in a second range from a downstream end of the upstream contact part to an upstream end of the downstream contact part in the conveying direction, out of the first range. In such a configuration, the ink is discharged to the second range between the upstream roller and the downstream roller where the formation of wrinkles is suppressed by these rollers. In this way, the formation of wrinkles in the range to which the ink is discharge can be suppressed.

The printing apparatus may be configured so that the ink discharging unit includes a plurality of discharge heads arranged in the conveying direction and causes the ink to be landed at a plurality of landing positions arranged at intervals in the conveying direction in the second range by causing each of the plurality of discharge heads to discharge the ink to the corresponding landing position; the conveying unit further includes an intermediate roller located between the upstream roller and the downstream roller in the conveying direction and configured to contact the printing medium between the landing positions adjacent in the conveying direction; and the intermediate roller is in contact with the printing medium on a peripheral surface shaped to increase a diameter from a center toward ends in an axial direction. In such a configuration, the formation of wrinkles at each landing position of the ink can be suppressed by the upstream, downstream and intermediate rollers.

The printing apparatus may further comprise: a plurality of ink receivers provided to face the plurality of discharge heads respectively; wherein the conveying unit causes the printing medium to pass between the discharge heads and the ink receivers facing each other; and the ink receiver receives the ink discharged from the facing discharge head and passing beside the printing medium without being landed on the printing medium. In such a configuration, the ink discharged from the discharge head for maintenance and passing beside the printing medium without being loaded on the printing medium can be received by the ink receiver. In addition, since each landing position is provided between adjacent ones of the rollers (upstream, downstream and intermediate rollers), the ink receiver can be arranged between adjacent ones of these rollers.

The printing apparatus may further comprise: a detecting unit configured to detect the position of the ink discharged to the printing medium by the ink discharging unit; and a control unit configured to correct a positional deviation of the ink due to the shape of the peripheral surface of each of the upstream roller and the downstream roller by controlling a timing at which the ink discharging unit discharges the ink based on the position of the ink detected by the detecting unit. In such a configuration, a good image can be printed by suppressing positional deviations of the ink due to the shape of the peripheral surface of each of the upstream and downstream rollers.

The printing apparatus may be configured so that the printing medium is a soft packaging material; and the ink discharging unit discharges water-based ink. That is, even if the soft packaging material is used as the printing medium, a good image can be printed with the water-based ink by suppressing the formation of wrinkles in the range to which the ink is discharge.

This invention is applicable to all printing technology.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A printing apparatus, comprising:

a conveying unit including an upstream roller and a downstream roller located downstream of the upstream roller in a conveying direction and configured to convey a printing medium in contact with the upstream roller and the downstream roller in the conveying direction by rotating the upstream roller and the downstream roller; and an ink discharging unit configured to discharge ink to the printing medium being conveyed by the conveying unit;

wherein:

each of the upstream roller and the downstream roller is in contact with the printing medium on a peripheral surface shaped to increase a diameter from a center toward ends in an axial direction;

the ink discharging unit includes a plurality of discharge heads arranged in the conveying direction;

the plurality of discharge heads cause inks to be landed at a plurality of landing positions, respectively;

the plurality of landing positions are arranged (1) at intervals in the conveying direction and (2) in a range from a downstream end of an upstream contact part, where the upstream roller and the printing medium are in contact with each other, to an upstream end of a downstream contact part, where the downstream roller and the printing medium are in contact with each other, in the conveying direction;

the conveying unit further includes an intermediate roller located between the upstream roller and the downstream roller in the conveying direction and configured to contact the printing medium between the landing positions adjacent in the conveying direction; and the intermediate roller is in contact with the printing medium on a peripheral surface shaped to increase a diameter from a center toward ends in an axial direction.

2. The printing apparatus according to claim 1, further comprising:

a plurality of ink receivers provided to face the plurality of discharge heads respectively; wherein the conveying unit causes the printing medium to pass between the discharge heads and the ink receivers facing each other; and each ink receiver receives the ink discharged from corresponding one facing discharge head and passing beside the printing medium without being landed on the printing medium.

3. The printing apparatus according to claim 1, further comprising:

a detecting unit configured to detect the position of the ink discharged to the printing medium by the ink discharging unit; and a control unit configured to correct a positional deviation of the ink due to the shape of the peripheral surface of each of the upstream roller and the downstream roller by controlling a timing at which the ink discharging unit discharges the ink based on the position of the ink detected by the detecting unit.

4. The printing apparatus according to claim 3, wherein:

each discharge head is formed such that a plurality of nozzles are arranged in the axial direction, the ink is discharged from each nozzle, and the control unit delays the ink discharge timing from the nozzles as going from the center toward both ends along the axial direction.

5. The printing apparatus according to claim 1, wherein:

the printing medium is a soft packaging material; and the ink discharging unit discharges water-based ink.

6. The printing apparatus according to claim 1, wherein there is no roller having a peripheral surface shaped to increase a diameter from a center toward ends in the axial direction between the upstream roller and a most upstream landing position out of the plurality of landing positions in the conveying direction.

7. The printing apparatus according to claim 1, wherein a number of the intermediate roller between the landing positions adjacent each other is one.

8. A printing apparatus, comprising:

a conveying unit including an upstream roller and a downstream roller located downstream of the upstream roller in a conveying direction and configured to convey a printing medium in contact with the upstream roller and the downstream roller in the conveying direction by rotating the upstream roller and the downstream roller;

an ink discharging unit configured to discharge ink to the printing medium being conveyed by the conveying unit;

a detecting unit configured to detect the position of the ink discharged to the printing medium by the ink discharging unit; and a control unit;

wherein:

each of the upstream roller and the downstream roller is in contact with the printing medium on a peripheral surface shaped to increase a diameter from a center toward ends in an axial direction;

the ink discharging unit includes a plurality of discharge heads arranged in the conveying direction;

the plurality of discharge heads cause inks to be landed at a plurality of landing positions, respectively;

the plurality of landing positions are arranged (1) at intervals in the conveying direction and (2) in a range from a downstream end of an upstream contact part, where the upstream roller and the printing medium are in contact with each other, to an upstream end of a downstream contact part, where the downstream roller and the printing medium are in contact with each other, in the conveying direction;

the control unit is configured to correct a positional deviation of the ink due to the shape of the peripheral surface of each of the upstream roller and the downstream roller by controlling a timing at which the ink discharging unit discharges the ink based on the position of the ink detected by the detecting unit each discharge head is formed such that a plurality of nozzles are arranged in the axial direction;

the ink is discharged from each nozzle; and the control unit delays the ink discharge timing from the nozzles as going from the center toward both ends along the axial direction.

* * * * *